United States Patent [19]

Takahashi et al.

[11] Patent Number: 4,909,217

[45] Date of Patent: Mar. 20, 1990

[54] ELECTRONIC-TYPE ENGINE CONTROL METHOD

[75] Inventors: Shinsuke Takahashi, Yokohama; Teruji Sekozawa, Kawasaki; Motohisa Funabashi, Sagamihara, all of Japan

[73] Assignee: Hitachi, Ltd., Tokyo, Japan

[21] Appl. No.: 320,585

[22] Filed: Mar. 8, 1989

[30] Foreign Application Priority Data

Mar. 9, 1988 [JP] Japan ..... 63-55893

[51] Int. Cl.[4] ..... F02D 7/00

[52] U.S. Cl. ..... 123/399; 123/340

[58] Field of Search ..... 123/399, 395, 361, 352, 123/340; 180/178, 179; 364/431.07

[56] References Cited

U.S. PATENT DOCUMENTS

| | | | |
|---|---|---|---|
| 4,506,642 | 3/1985 | Pfalzgraf et al. | 123/361 |
| 4,515,126 | 5/1985 | Kassler | 123/399 |
| 4,524,745 | 6/1985 | Tominari et al. | 123/399 |
| 4,569,320 | 2/1986 | Collonia | 123/399 |
| 4,640,243 | 2/1987 | Abo et al. | 123/399 |
| 4,671,235 | 6/1987 | Hosaka | 123/352 |
| 4,707,792 | 11/1987 | Naitou | 364/431.07 |
| 4,765,296 | 8/1988 | Ishikawa et al. | 123/340 |

*Primary Examiner*—Raymond A. Nelli

*Attorney, Agent, or Firm*—Fay, Sharpe, Beall, Fagan, Minnich & McKee

[57] ABSTRACT

A novel engine control method is disclosed in which in order to dampen the longitudinal oscillation of a vehicle such as an automobile and to prevent the deterioration of the exhaust gas purification performance thereof, the longitudinal acceleration or the engine speed of the vehicle is detected, and the detected vehicle acceleration or engine speed, as the case may be, is differentiated. A signal with the phase of the differentiated value advanced by a specific value is produced and used to compensate for the fuel injection time or a target value of throttle opening degree.

9 Claims, 8 Drawing Sheets

ELECTRONIC-TYPE ENGINE CONTROL METHOD

BACKGROUND OF THE INVENTION

The present invention relates to an engine control method for an electronic-type engine control system, or more in particular to an engine control method capable of dampening the longitudinal oscillation of a vehicle such as an automobile under acceleration.

The driver and passengers feel uncomfortable when the vehicle pitches or oscillates in the longitudinal directions (running directions) of the vehicle under acceleration.

Methods of preventing such a longitudinal oscillation of the vehicle by an electronic-type control system have been suggested.

In a method disclosed in JP-A-59-231144 or JP-A-60-30446, for example, compensation is made by the fuel injection during deceleration. According to a method disclosed in JP-A-59-93945, on the other hand, compensation is secured by ignition advance or fuel supply amount to minimize the torque variations during the drive at a very low speed.

The conventional methods described above, though capable of dampening the longitudinal oscillation of the vehicle during steady run or deceleration, pose the problem that effective dampening of oscillation is difficult during acceleration. This is due to the fact that means has not yet been introduced for detecting the longitudinal oscillation of the vehicle during acceleration.

Another problem of the prior art is that the ignition advance or the amount of fuel supplied is set in such a manner as to dampen gas discharge or to shift from the original value of control, and therefore the exhaust gas purification performance is deteriorated.

SUMMARY OF THE INVENTION

An object of the present invention is to improve the above-mentioned problems and to provide an engine control method by which the longitudinal oscillation of a vehicle can be dampened even during acceleration without adversely affecting the exhaust gas purification performance.

In order to achieve the aforementioned object, according to the present invention, there is provided an engine control method comprising steps of calculating the fuel injection time from various detection amounts representing the engine operating conditions, and controlling the amount of fuel supplied to a cylinder on the basis of the result of the calculation or calculating a target value of throttle opening degree from various detection amounts indicating the engine operating conditions thereby to control the throttle in such a manner that the detected throttle opening degree coincides with the target value, wherein the method further includes steps of determining a differentiated value of the acceleration of the vehicle detected by means for detecting the longitudinal acceleration of the vehicle (acceleration sensor) or the value of engine speed detected by an engine speed detector, producing a signal associated with the differentiated value advanced by a specific amount, and compensating for the target value of the throttle opening degree or the fuel injection time thereby to calculate an effective value (a value to be executed).

The phase of a signal having a frequency hereinafter called the "surge frequency") equal to the longitudinal vibrations of the vehicle which is caused upon rapid opening or closing of the throttle valve is advanced by a specific value in accordance with the operating conditions of the engine at that particular time.

The specific value referred to above is, for example, the phase difference between the fuel injection time and the engine-generated torque with the fuel injection time changed by the surge frequency under an engine operating condition similar to the one for correction of the fuel injection time.

Also, the above-mentioned specific value may be the phase difference between a target value of throttle opening degree and an engine-generated torque with the target of engine throttle opening degree changed in accordance with the surge frequency under a similar engine operating condition to the ne at the time of compensation.

In advancing the phase mentioned above, the input/output gain against the surge frequency is set to any one of the following. (1) When the throttle opening target is compensated, the gain is set to a variable proportional to the reciprocal of the amplitude ratio between the target value of throttle opening and the engine-generated torque (amplitude of output signal/amplitude of input signal) with the target of throttle opening changed by the surge frequency under an engine operating condition similar to that for compensation.

(2) When the fuel injection time is compensated, on the other hand, the gain is set to a variable proportional to the reciprocal of the amplitude ratio between the fuel injection time and the engine-generated torque (output signal amplitude/input signal amplitude) with the fuel injection time changed by the surge frequency under an engine operating conditions similar to that for compensation.

In (1) and (2) above, there are a plurality of proportionally constants between the input/output gain and the reciprocal of the amplitude ratio, and an appropriate proportionality constant is changed as selected by the driver.

In the above-mentioned compensation process, if the output of the phase-advancing unit is positive, the target value of the fuel injection time or the throttle opening degree is reduced to a level smaller than the original value. If the output of the phase advancing unit is negative, on the other hand, the fuel injection time or the target value of the throttle opening degree is increased to a level higher than the original value.

According to the present invention, when the vehicle develops a longitudinal oscillation, assume that the target value of fuel injection time or throttle opening degree is compensated on the basis of the output signal (c) of the phase advancing unit. The increment of these values (compensation amount) is indicated as (d) in reverse phase to (c) by the compensation unit.

Also, if the effect of compensation is exhibited in the engine-generated torque, the torque increment is indicated as (e).

This signal (e) is opposite in phase to the output signal (b) of the differentiation means under the effect of differentiation at the phase advancing process.

Further, when a signal (e) representing the increment of the engine-generated torque is transmitted to a tire, the torque increment of the drive shaft involved is indicated as a signal (f) retarded by 90° from the signal (e).

On the other hand, the signal (f) is opposite in phase to the signal (a), so that the torque of the drive shaft is decreased during the increase in acceleration, while the drive shaft torque is increased during acceleration decrease, thus dampening the vibrations of acceleration (longitudinal oscillation of vehicle).

Also in the case where an engine speed detection means is provided, the engine-generated torque is decreased during the increase in engine speed, and vice versa, thus dampening the longitudinal oscillation of the vehicle.

DESCRIPTION OF THE PREFERRED EMBODIMENTS

An embodiment of the present invention will be explained below with reference to the accompanying drawings.

First, explanation will be made about an engine control method for compensating for a target value of throttle opening degree by use of the acceleration as a data related to the longitudinal vibrations of a vehicle.

Figure 3:
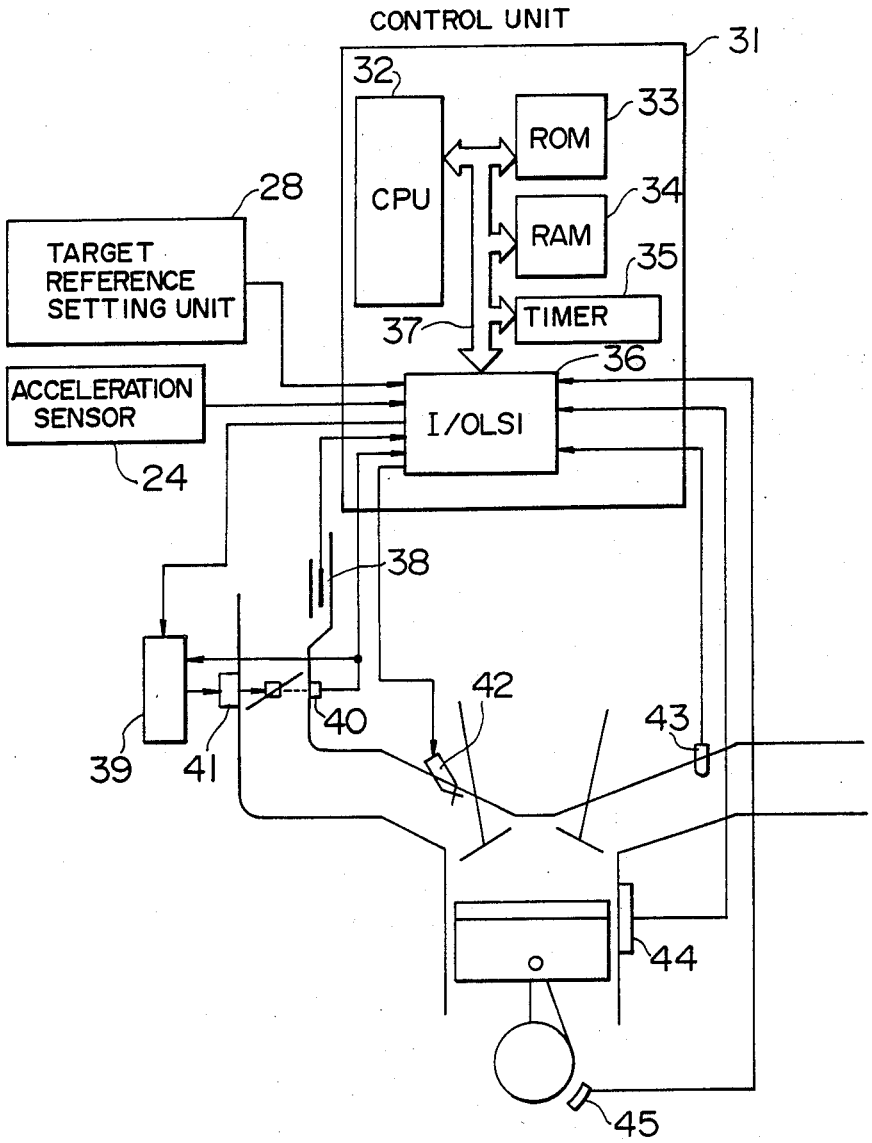
FIG. 3 is a diagram showing a configuration of an electronic engine control system according to the first embodiment of the present invention.

FIG. 3 is a diagram showing a configuration of an electronic engine control system according to a first embodiment of the present invention.

An electronic engine control system according to this embodiment comprises an acceleration sensor 24, an operating condition target reference setting unit 28, a control unit 31, an air amount sensor 38, a throttle control unit 39, a throttle angle sensor 40, a throttle actuator 41, an injector 42, an oxygen sensor 43, a water temperature sensor 44 and a crank angle sensor 45.

The control unit 31 is a digital control unit including a CPU 32, a ROM 33, a RAM 34, a timer 35 and an I/O LSI 36 which are connected electrically by a bus 37.

The I/O LSI 36 is supplied with signals from an acceleration sensor 24, unit 28 for setting a target reference of engine operating conditions, the air amount sensor 38 for measuring an amount of suction air per unit time, the oxygen sensor 43, the water temperature sensor 44 and the crank angle sensor 45 and applies a signal to a throttle control unit 39, the injector 42, etc. The I/O LSI 36 includes an A/D converter and a D/A converter.

The timer 35 generates an interrupt request at regular time intervals against the CPU 32, and in response to this interrupt request, the CPU 32 executes the control program stored in the ROM 33.

Figure 4:
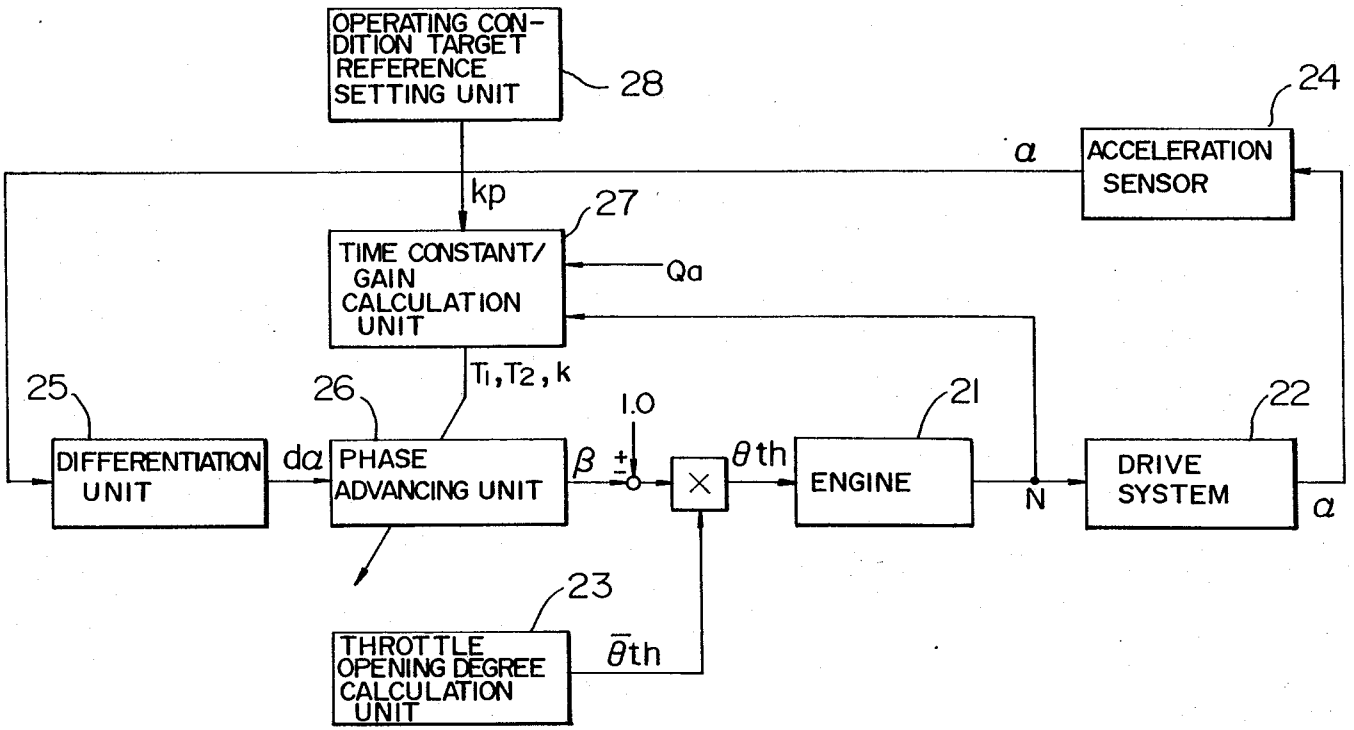
FIG. 4 is a block diagram of an electronic engine control system according to the first embodiment of the present invention.

FIG. 4 is a control block diagram of an electronic engine control system according to a first embodiment of the present invention, and FIG. 5 a diagram for explaining the phase difference in the first embodiment of the invention.

The control section of the control unit 31 according to this embodiment includes, as shown in FIG. 4, throttle opening degree calculation unit 23, differentiation unit 25, phase advancing unit 26, time constant/gain calculation unit 27 and the unit 28 for setting a target reference of operating conditions.

The differentiation unit 25, in response to an acceleration $\alpha$ fetched through the acceleration sensor 24, calculates $d\alpha/dt$ thereby to produce a differentiation value $d\alpha$ of acceleration.

According to the present embodiment, the acceleration sensor 24 receives a data on the longitudinal oscillation (acceleration $\alpha$) of the vehicle from the drive system 22 and feeds it back to the differentiation unit 25.

The phase advancing unit 26 is supplied with the acceleration differentiation value $d\alpha$ and produces a throttle opening degree compensation factor $\beta$.

The input and output characteristics are assumed to be given by the equation (1) below in accordance with the transfer function in the Laplace region. Also, the transfer function is such an element that the input phase may be advanced by the desired value.

$$k(1+T_2 \cdot S)/(1+T_1 \cdot S) \quad (1)$$

where the parameters k, $T_1$ and $T_2$ are calculated and corrected from time to time as required by the time constant/gain calculation unit 27. Also, the time constants $T_1$ and $T_2$ are set in such a manner that the phase of a signal having a frequency equal to the longitudinal oscillation of the vehicle, that is, the surge frequency $f_0$ is advanced by a phase delay $\phi$ (phase difference) before the effect of a throttle opening change is reflected in a torque change.

Further, the gain k is set in such a way that the input/output gain in equation (1) against the signal of the surge frequency $f_0$ is proportional to the reciprocal of the amplitude ratio $k_0$ of the two variables of the engine-generated torque and the throttle opening target changed by the frequency $f_0$.

Specifically, the parameters k, $T_1$ and $T_2$ are calculated by the equations (2) to (4) below from the surge frequency $f_0$ and the phase difference $\phi$.

$$T_1 = 1/(2\pi f_0)\sqrt{(1-\sin\phi)/(1+\sin\phi)} \quad (2)$$

$$T_2 = 1/(2\pi f_0)\sqrt{(1+\sin\phi)/(1-\sin\phi)} \quad (3)$$

$$k = k_p/k_0 \log\{(1+\sin\phi)/(1-\sin\phi)\} \quad (4)$$

where $k_p$ is a variable settable by the driver using the operating condition target reference setting unit 28 including a switch having a variable resistor or the like. As a result, by changing this variable through the operation of the switch, the correction level of the target value of the throttle opening degree may be changed against the same pattern of detected acceleration, thus producing the operating condition desired by the driver.

The surge frequency $f_0$, on the other hand, is a value specific to the vehicle and is obtained by measuring the longitudinal oscillation of the vehicle caused during rapid opening of the throttle and determining the frequency of the particular oscillation.

Figure 5A:
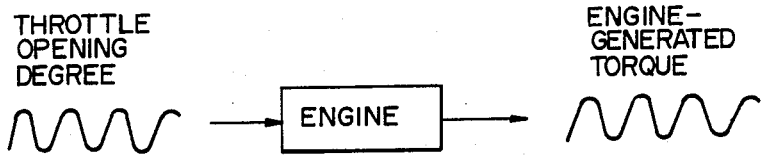
FIGS. 5A and 5B are diagrams for explaining the phase difference in the first embodiment of the present invention.
Figure 5B:
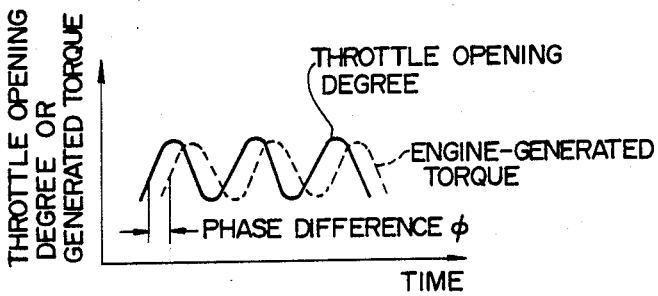

The phase difference $\phi$ changes with the engine operating conditions, especially, the engine speed or air amount. As shown in FIG. 5A, therefore, the engine is kept in steady running state, and the engine-generated torque is measured with the throttle opening degree target value changed in sinusoidal waveform in various operating regions, so that as shown in FIG. 5B, the phase difference between the input and output signals is calculated and prepared into a too-dimensional map with the engine speed N and the air amount $Q_a$. Specifically, the phase difference $\phi$ is calculated from the equation (5) below on the basis of the engine speed N and the air amount (an amount of suction air per unit time) $Q_a$.

$$\phi = f(N, Q_a) \quad (5)$$

In similar manner, the amplitude ratio $k_0$ is obtained by calculating the amplitude ratio between the input and output signals mentioned above and preparing a two-dimensional map of the engine speed N and the air amount $Q_a$ therefrom. In other words, the amplitude ratio $k_0$ is calculated from the equation (5)' below.

$$k_0 = g(N, Q_a) \quad (5)'$$

The throttle opening degree calculation unit 23 is generally known for calculating a target value of the throttle opening. For example, it is an unit for calculating a target value of the throttle opening degree in such a manner that the detected torque coincides with a target thereof.

The effective value $\theta_{th}$ of the target of the throttle opening degree, on the other hand, is determined from the equation (6) below on the basis of an output $\beta$ of the phase advancing unit 26 and the output $\overline{\theta}_{th}$.

$$\theta_{th} = \overline{\theta}_{th}(1-\beta) \quad (6)$$

The equation (7) may replace the equation (6).

$$\theta_{th} = \overline{\theta}_{th} - \beta \quad (7)$$

The signal thus obtained is applied to throttle control unit 39 to control the throttle in such a manner that the detected throttle opening degree may coincide with the target thereof.

The engine speed N is obtained by the crank angle sensor 45 from the engine 21, and the longitudinal oscillation of the vehicle is produced by the acceleration sensor 24 from the kinetic system o the vehicle including the drive system 22.

The engine intake air amount is obtained, on the other hand, from the air amount sensor 38.

The engine speed N, the acceleration $\alpha$, the air amount $Q_a$ thus determined are applied to the control unit 31 through the I/O LSI 36, and used to calculate the effective value of the target of the throttle opening at regular intervals of time.

The operation of the system configured as above will be explained in dampening the longitudinal oscillation of the vehicle by the control unit 3 with the throttle opening corrected. This operation is executed by the control program in the ROM 33.

Figure 1:
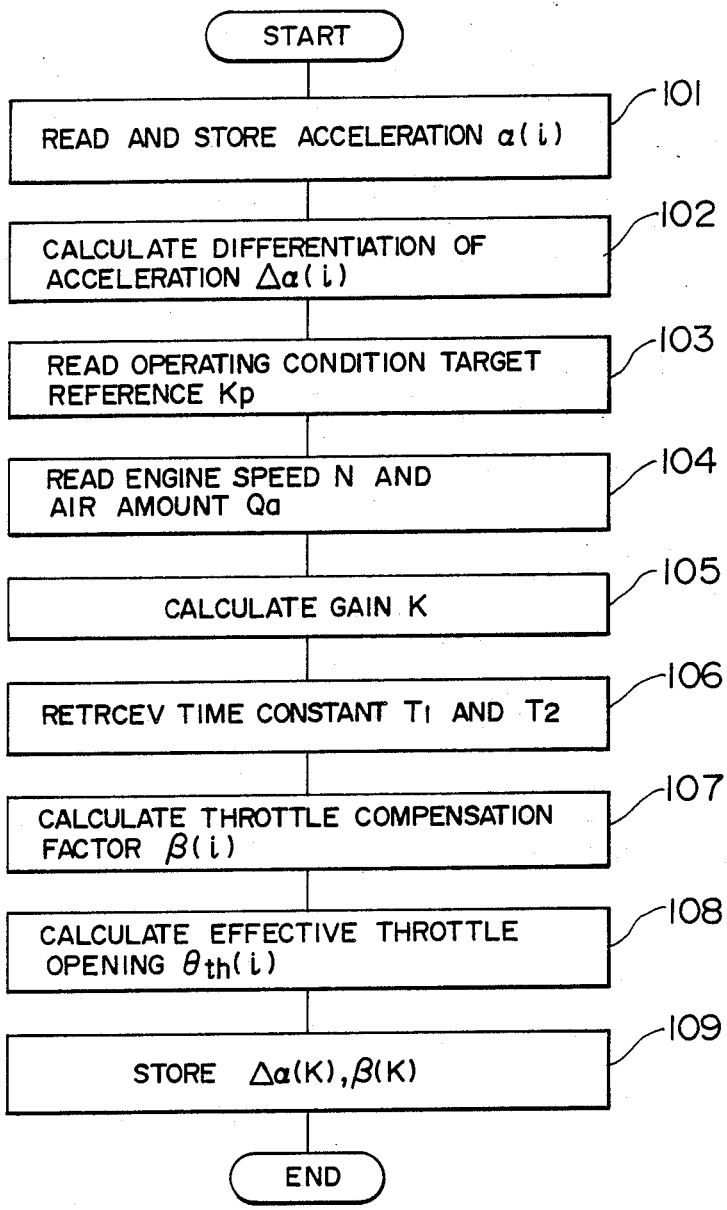
FIG. 1 is a flowchart showing an operating procedure of control unit according to a first embodiment of the present invention.
Figure 2A:
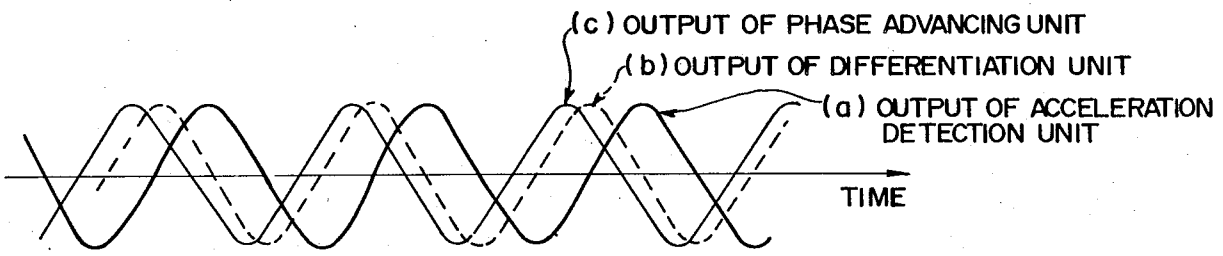
FIGS. 2A and 2B are timing charts of output signals of respective means with longitudinal oscillation of the vehicle generated in the first embodiment of the present invention.
Figure 2B:
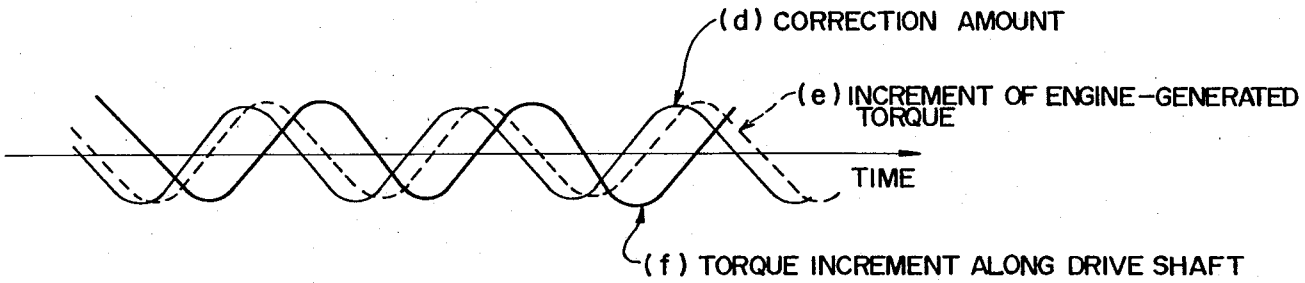
Figure 6:
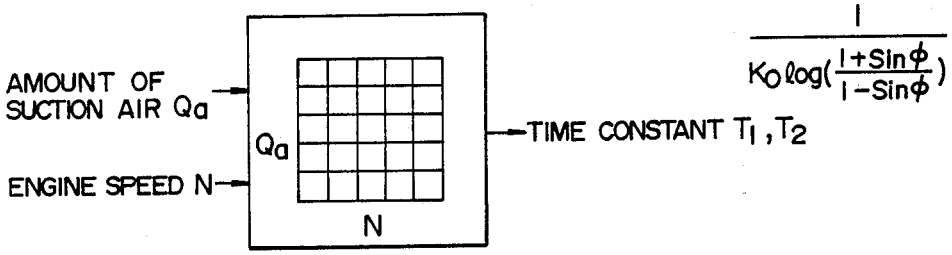
FIG. 6 is a diagram for explaining a two-dimensional map for storing a time constant and a gain according to the first embodiment of the present invention.

FIG. 1 is a flowchart showing the operating procedure of the control unit according to a first embodiment of the present invention, and FIG. 6 a diagram for explaining the two-dimensional map storing the time constant and gain for the first embodiment of the invention.

According to this embodiment, the control program is started when the longitudinal oscillation of the vehicle is generated or forecast to be generated. This decision is made from whether the absolute value of the differentiation of the throttle opening degree or acceleration has exceeded a predetermined value.

Upon starting of this control program, the acceleration sensor 24 reads the acceleration $\alpha(i)$, which is stored in the RAM 34 (block 101).

The differentiation value of acceleration $\Delta\alpha(i)$ is then calculated from the equation (8) below on the basis of the acceleration $\alpha(i-1)$ read and stored in the RAM 34 at the time of previous interruption and the acceleration $\alpha(i)$ read at step 101 (block 102).

$$\Delta\alpha(i) = (\alpha(i) - \alpha(i-1))/\Delta t \quad (8)$$

where $\Delta t$ is an interruption period.

Then, the driver reads a target reference of operating conditions $k_p$ settable by the operating condition target reference setting means 28 such as a switch (block 103).

The engine speed N and the air amount $Q_a$ are then read (block 104).

The formula $1/k_0 \log((1+\sin\phi)/(1-\sin\phi))$ in equation (4) is then calculated by use of equations (5) and (5)' in various operating regions of the engine speed N and the air amount $Q_a$, and written in a two-dimensional map as shown in FIG. 6. The figures are then read from the two-dimensional map at step 104, and the value determined by retrieval of the two-dimensional map from the engine speed N and the air amount $Q_a$ is multiplied by $k_p$ thereby to produce the gain k in equation (1) (block 105). The procedure is taken because it is difficult to obtain the gain k by retrieval of the two-dimensional map by the calculation of the logarithm and trigonometric function in a microcomputer.

The time constants $T_1$ and $T_2$ are then determined by retrieving the two-dimensional map shown in FIG. 6 from the engine speed and the air amount read at block 104 (block 106). In this case, the data in the two-dimensional map is calculated by use of equations (2), (3) and (5) in various operating regions of engine speed and air amount. The two-dimensional map is used for retrieval because it is difficult to conduct calculations of square roots and trigonometric functions in a microcomputer.

Assuming that the input is a differentiated value $d\alpha$ of acceleration and the output a throttle opening compensation factor $\beta$ with the transfer characteristic thereof given from equation (1), the throttle opening compensation $\beta(i)$ is determined from the difference equation of the differential equation of the variables $d\alpha$, $\beta$ (block 107).

The difference equation is given from the equation (9) below.

$$\beta(i)+T_1\{\beta(i)-\beta(i-1)\}/\Delta t=k[\Delta\alpha(i)+T_2\{\Delta\alpha(i)-\Delta\alpha(i-1)\}/\Delta t] \quad (9)$$

where $\Delta t$ is an interruption period.

On the other hand, the compensation factor $\beta(i)$ is calculated from the equation (8) on the basis of the differentiated value $\Delta\alpha(i)$ of acceleration determined at block 102, the differentiated value $\Delta\alpha(i-1)$ of acceleration determined and stored at the previous time of interruption, k, $T_1$ and $T_2$ determined at blocks 105 and 106 and the compensation factor $\beta(i-1)$ calculated and stored at the previous time of interruption.

As the next step, the effective target value $\theta_{th}$ of throttle opening degree is calculated from the original target value $\overline{\theta}_{th}(i)$ and the compensation factor $\beta(i)$ determined at block 107 by the equation (10) below (block 108).

$$\theta_{th}(i)=(1-\beta(i))\overline{\theta}_{th}(i) \quad (10)$$

Finally, $\Delta\alpha(i)$ and $\beta(i)$ are written in the memory addresses of $\Delta\alpha(i-1)$ and $\beta(i-1)$ and appropriately processed to stand by for the next interrupt request (block 109).

The features of the present embodiment will be described below in comparison with those of the conventional methods.

FIG. 7 is a diagram for explaining the manner in which the longitudinal oscillation of the vehicle is dampened according to the first embodiment of the resent invention.

Figure 7A:
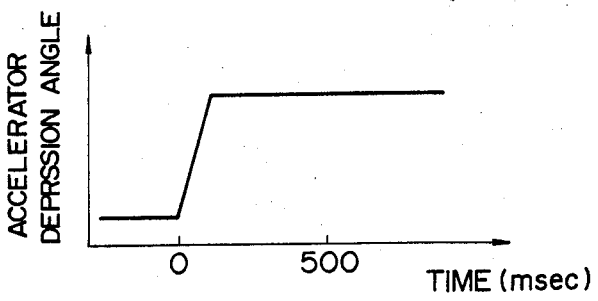
FIGS. 7A, 7B and 7C are diagrams for explaining the longitudinal oscillation of the vehicle being deampened according to the first embodiment of the present invention.
Figure 7B:
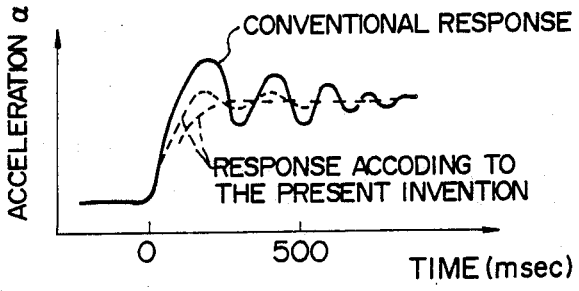
Figure 7C:
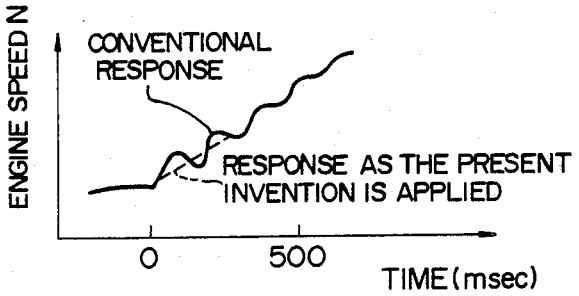

In the case where the accelerator depression angle is increased rapidly as shown in FIG. 7A, the acceleration and engine speed undergo a change as shown by dotted lines in FIGS. 7B and 7C. As compared with the response in the conventional systems shown by solid line, the response according to the present embodiment shown by dotted line follows a smooth curve of change for both the acceleration in FIG. 7B and engine speed in FIG. 7C, indicating that the longitudinal oscillation of the vehicle is dampened very effectively.

The acceleration shown in FIG. 7B is represented by two types of dotted lines resulting from the fact that the magnitude of the control gain $k_p$ is controlled in two types by the operating condition target reference setting unit 28. In this way, by setting two or more types of the magnitude of the control gain $k_p$, the driver is capable of selecting the desired response by a switch or the like.

According to the present embodiment, the throttle opening degree is corrected and controlled in such a manner as to compensate for the delay of torque generation and dampen the oscillation of acceleration, thereby making it possible to dampen the longitudinal oscillation of the vehicle effectively in all operating regions.

Now, explanation will be made about an engine control method for correcting the fuel injection time by using the engine speed as a data related to the longitudinal oscillation of the vehicle.

Figure 8:
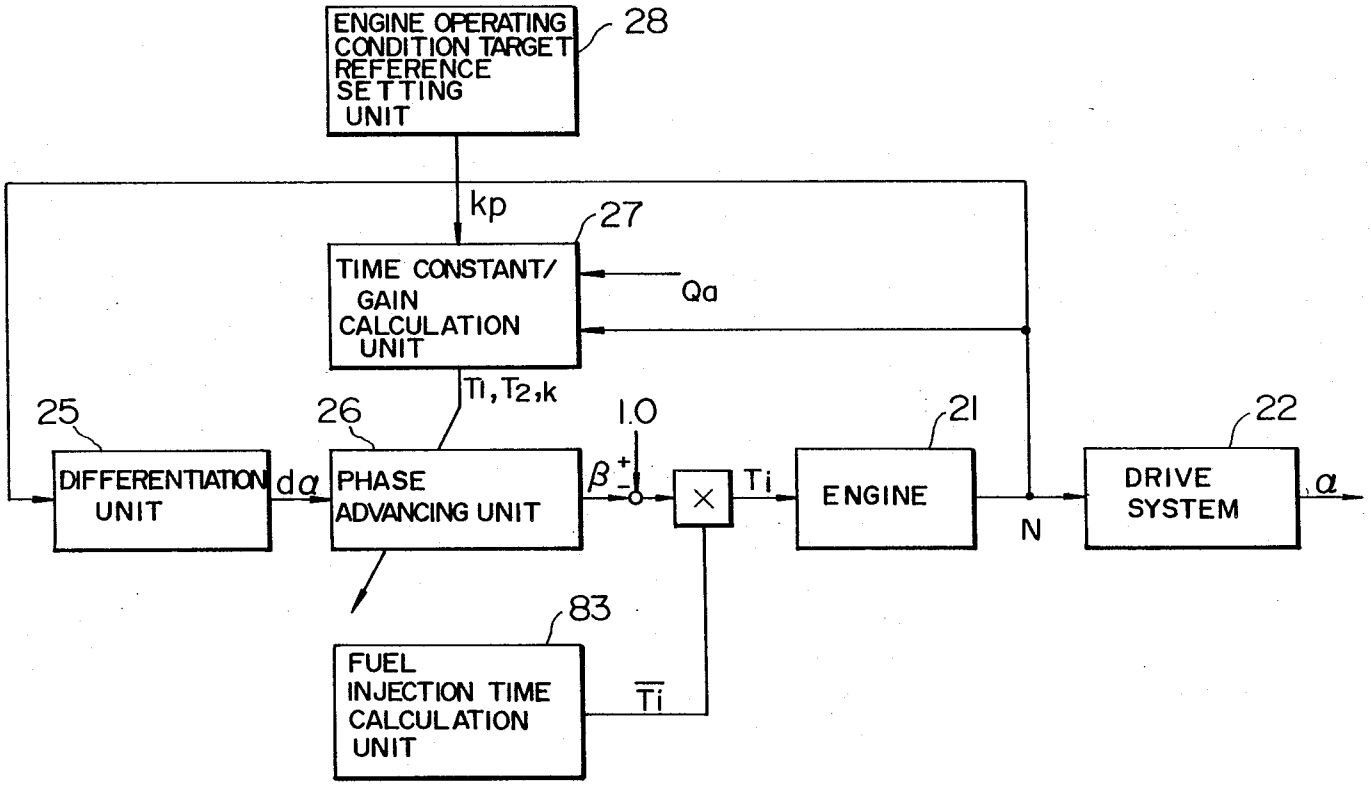
FIG. 8 is a block diagram showing an electronic engine control system according to a second embodiment of the present invention.
Figure 9:
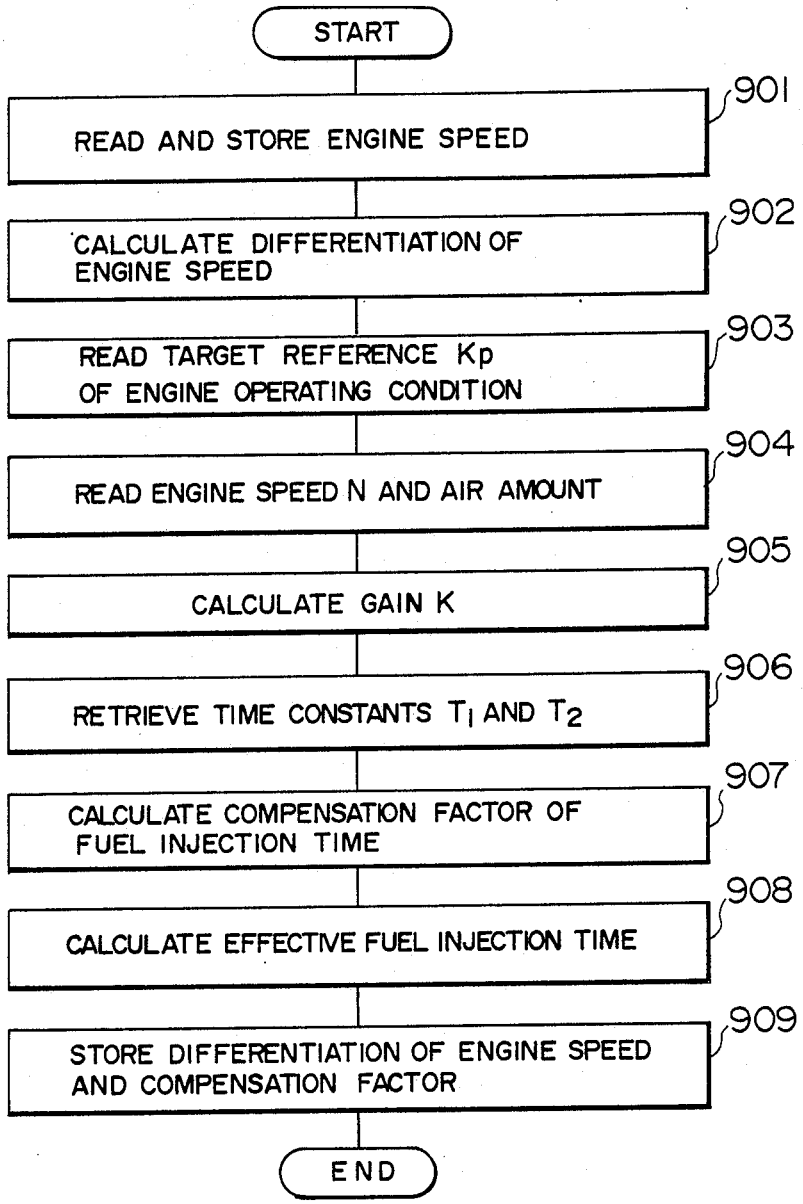
FIG. 9 is a flowchart showing an operation procedure of a control unit according to the second embodiment of the present invention.

FIG. 8 is a block diagram for control of an electronic-type engine control system according to the second embodiment of the present invention, and FIG. 9 a flowchart showing the operation of the control unit according to the second embodiment.

The engine control system according to this embodiment, like the first embodiment shown in FIG. 3, includes a control unit having a CPU, a RAM, a timer and an I/O LSI, operating condition target reference setting unit, throttle control unit, throttle angle sensor, a throttle actuator, an air amount sensor, an injector, an oxygen sensor, a water temperature sensor and a crank angle sensor. No acceleration sensor is included because in place of the method according to the first embodiment in which the oscillation is dampened by correcting the target value of the throttle opening degree, the present embodiment employs a method of correcting the fuel injection time (period) and also feeding back the engine speed instead of acceleration.

The preset embodiment is so configured that as shown in FIG. 8 the control section of the control unit includes differentiation unit 25, phase advancing unit 26, time constant/gain calculation unit 27, operating condition target reference setting unit 28 and fuel injection time calculation unit 83, which are connected to an engine 21 and a drive system 22.

The differentiation unit 25 is fed back with the engine speed data N from the engine 21 in place of the acceleration $\alpha$ in the first embodiment. Further, the differentiation means 25 differentiates the engine speed and applies the differentiated value to the phase advancing unit 26.

According to the present embodiment, the throttle opening degree calculation unit 23 in the first embodiment is replaced by the fuel injection time calculation unit 83, the output of which is compensated to produce an effective value. The calculation of a differentiated value of engine speed, retrieval of a time constant, gain calculation, calculation of the compensation factor of the fuel injection time and the effective fuel injection time are effected in similar manner to those effected using the various equations in FIGS. 5A to 7C (first embodiment).

In this configuration, the control program shown in FIG. 9 is used or dampening the longitudinal oscillation of the vehicle under acceleration by compensating for the fuel injection time with the engine speed in the control unit. This control program is started when the longitudinal oscillation of the vehicle is forecast by a method of deciding whether the absolute value of the change rate of the throttle opening degree of fuel injection time has exceeded a predetermined value or not.

First, the engine speed retrieved from the engine 21 and stored in the RAM is read (block 901).

The engine speed read and stored in the RAM at the time of the previous interruption is used together with the present engine speed to calculate the differentiated value of the engine speed from the equation (8) (block 902).

Then, the target reference $k_p$ set by the driver with the operating condition target reference setting means 28 is read (block 903).

The engine speed and the air amount are read (block 904), the two-dimensional map obtained from the equations (4), (5) and (5)' (See FIG. 6) is searched, and the value obtained is multiplied by $k_p$ thereby to determine the gain k in equation (1) (block 905).

The two-dimensional map is searched in a similar manner by the engine speed and the air amount read thereby to determine the time constants $T_1$ and $T_2$ (block 906).

In the case where an input is provided in the form of a differentiation of the engine speed and an output in the form of a compensation factor for the fuel injection time with the transfer characteristic thereof given by equation (1), the compensation factor for the fuel injection time is obtained from the difference equation of the differential equation of these variables (block 907). The difference equation is obtained by use of equation (9).

The effective value of the fuel injection time is calculated by use of the equation (10) from the original fuel injection time and a compensation factor thereof (block 908).

Further, the differentiated value of the present engine speed and the compensation factor are written in the addresses of the previous differentiated value of the engine speed and the compensation factor (block 909).

It will thus be understood from the foregoing description that according to the present invention, the throttle opening is controlled in such a manner as to compensate for the delay of engine torque generation and to assure the opposite phase relations between the differentiated value of the longitudinal oscillation of the vehicle and the increment of engine-generated torque thereby to effectively control the longitudinal oscillation of the vehicle.

Further, the desired acceleration response is capable of being selected by the driver for an improved drivability.

Furthermore, the control effected by the air amount prevents the deterioration of the exhaust gas purification performance as compared with the control using fuel and ignition advance.

The present invention may be arranged so as to control the fuel injection time and the throttle valve opening degree target value in accordance with signals prepared on the basis of the differentiations of the detected longitudinal acceleration and the engine speed, respectively.

We claim:

1. An engine control method comprising selected one of two steps, one for calculating the fuel injection time from various detection values representing the engine operating conditions so that the amount of fuel supplied to a cylinder is controlled in accordance with the result of calculation and the other for calculating a target value of throttle valve opening degree from various detection values representing the engine operating conditions so that the throttle valve opening degree is controlled in such a manner that a detected throttle valve opening degree coincides with the target value, said engine control method further comprising steps of:

differentiating selected one of longitudinal acceleration detected by means for detecting the longitudinal acceleration of the vehicle and an engine speed detected by means for detecting the engine speed;

producing a signal whose phase is advanced by a specific value relative to the differentiated value; and compensating for selected one of fuel injection time and a target value of th throttle valve opening degree in accordance with said output signal.

2. An engine control method according to claim 1, wherein the phase-advancing process is performed in a manner that the phase of the signal having a frequency equal to the longitudinal oscillation of the vehicle caused by one of rapid closing and rapid opening of the throttle valve is advanced by a specific value in accordance with the prevailing engine operating conditions.

3. An engine control method according to claim 2, wherein said specific value is a phase difference between an engine-generated torque and a fuel injection time changed by a frequency equal to the longitudinal oscillation of the vehicle caused upon one of rapid opening and rapid closing of the throttle valve under the same engine operating conditions as when the fuel injection time is compensated for.

4. An engine control method according to claim 2, wherein said specific value is a phase difference between an engine-generated torque and a target value of throttle valve opening degree changed by a frequency equal to the longitudinal oscillation of the vehicle caused upon one of rapid opening and rapid closing of the throttle valve under the same engine operating conditions as when the target value of the throttle valve opening degree is compensated for.

5. An engine control method according to claim 1, wherein the phase-advancing process is performed in a manner that an input/output gain against a frequency equal to the longitudinal oscillation of the vehicle caused upon one of rapid opening and rapid closing of the throttle valve is set to a variable proportional to reciprocal of an amplitude ratio between the engine-generated torque and the throttle valve opening target value changed by said frequency under the same engine operating conditions as when the throttle valve opening target value is compensated for.

6. An engine control method according to claim 1, wherein the phase-advancing process is performed in a manner that the input/output gain against a frequency equal to the longitudinal oscillation of the vehicle caused upon one of rapid opening and rapid closing of the throttle valve is set to a variable proportional to the reciprocal of an amplitude ratio between the engine-generated torque and the fuel injection time changed by said frequency under the same engine operating conditions as when the fuel injection time is compensated for.

7. An engine control method according to claim 5, wherein the phase-advancing process is performed in a manner that a plurality of proportionality constants between the input/output gain ad the reciprocal of the amplitude ratio are provided and the proportionality constants are changed at the option of the driver.

8. An engine control method according to claim 6, wherein the phase-advancing process is performed in a manner that a plurality of proportionality constants between the input/output gain and the reciprocal of the amplitude ratio are provided and the proportionality constants are changed at the option of the driver.

9. An engine method according to claim 1, wherein the compensation process is performed in a manner that selected one of the fuel injection time and the throttle opening target value is made smaller than an original value thereof if the advanced phase is positive and selected one of the fuel injection time and the throttle valve opening target value is made larger than an original value thereof if the advanced phase is negative.

* * * * *